US007512371B2

(12) United States Patent
Higaya

(10) Patent No.: US 7,512,371 B2
(45) Date of Patent: Mar. 31, 2009

(54) METHOD AND APPARATUS FOR IMAGE FORMING CAPABLE OF EFFECTIVE IMAGE FIXING USING INDUCTION HEATING

(75) Inventor: Toshiaki Higaya, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 247 days.

(21) Appl. No.: 11/222,813

(22) Filed: Sep. 12, 2005

(65) Prior Publication Data

US 2006/0056889 A1 Mar. 16, 2006

(30) Foreign Application Priority Data

Sep. 10, 2004 (JP) ..... 2004-263187

(51) Int. Cl.
*G03G 15/20* (2006.01)

(52) U.S. Cl. ..... 399/330; 219/216; 219/619; 399/329

(58) Field of Classification Search ..... 399/328, 399/329, 330, 331, 333, 334, 335; 219/216, 219/619

See application file for complete search history.

(56) References Cited

U.S. PATENT DOCUMENTS

| | | | | |
|---|---|---|---|---|
| 4,570,044 | A * | 2/1986 | Kobayashi et al. | 219/619 |
| 5,300,996 | A | 4/1994 | Yokoyama et al. | |
| 5,426,495 | A | 6/1995 | Sawamura et al. | |
| 5,594,540 | A | 1/1997 | Higaya et al. | |
| 5,832,354 | A | 11/1998 | Kouno et al. | |
| RE36,124 | E | 3/1999 | Yokoyama et al. | |
| 5,915,147 | A | 6/1999 | Kouno et al. | |
| 6,069,347 | A * | 5/2000 | Genji et al. | 219/619 |
| 6,169,871 | B1 | 1/2001 | Higaya | |
| 6,255,632 | B1 | 7/2001 | Yokoyama et al. | |
| 6,262,404 | B1 | 7/2001 | Higaya et al. | |
| 6,292,648 | B1 | 9/2001 | Higaya et al. | |
| 6,327,456 | B1 | 12/2001 | Higaya | |
| 6,340,810 | B2 | 1/2002 | Yokoyama et al. | |
| 6,341,211 | B1 * | 1/2002 | Tsujimoto et al. | 399/330 |
| 6,366,757 | B1 * | 4/2002 | Tsujimoto et al. | 399/329 |
| 6,574,448 | B2 | 6/2003 | Mochimaru et al. | |
| 6,753,515 | B2 | 6/2004 | Miyahara et al. | |

(Continued)

FOREIGN PATENT DOCUMENTS

JP 07152277 A * 6/1995

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus includes a fixing unit for fixing a toner image on a recording sheet. In the fixing unit, a magnetic flux generator generates magnetic flux to induce heat in a fixing roller. The recording sheet having the toner image is inserted between the fixing roller and a pressure roller pressingly contacting the fixing roller. The fixing roller applies heat to the recording sheet. The pressure roller applies pressure to the recording sheet. The heat and pressure fix the toner image on the recording sheet. The magnetic flux generator is disposed to face outer and inner circumferential surfaces of the fixing roller. The magnetic flux generator is formed in a U-like or loop-like shape, and the fixing roller is placed in a gap or a loop of the magnetic flux generator. The magnetic flux generator may include a single wire.

37 Claims, 4 Drawing Sheets

U.S. PATENT DOCUMENTS

| | | | | |
|---|---|---|---|---|
| 6,810,230 | B2 * | 10/2004 | Imai et al. | 399/328 |
| 6,899,986 | B2 | 5/2005 | Aoki et al. | |
| 6,900,419 | B2 * | 5/2005 | Takagi et al. | 219/619 |
| 6,989,516 | B1 * | 1/2006 | Domoto | 219/619 |
| 7,076,196 | B2 * | 7/2006 | Takahashi et al. | 399/328 |
| 7,106,999 | B2 * | 9/2006 | Takahashi | 399/328 |
| 2004/0188423 | A1 | 9/2004 | Miyahara et al. | |
| 2005/0079430 | A1 | 4/2005 | Aoki et al. | |
| 2005/0286938 | A1 * | 12/2005 | Aze et al. | 399/328 |
| 2006/0289420 | A1 * | 12/2006 | Hasegawa et al. | 219/216 |

FOREIGN PATENT DOCUMENTS

| | | | |
|---|---|---|---|
| JP | 08152798 | A * | 6/1996 |
| JP | 2000-39797 | | 2/2000 |
| JP | 2000-223257 | | 8/2000 |
| JP | 2001-159857 | | 6/2001 |
| JP | 2003-255731 | | 9/2003 |
| JP | 3504943 | | 12/2003 |

* cited by examiner

METHOD AND APPARATUS FOR IMAGE FORMING CAPABLE OF EFFECTIVE IMAGE FIXING USING INDUCTION HEATING

CROSS-REFERENCE TO RELATED APPLICATIONS

The present application is based on and claims priority to Japanese patent application no. 2004-263187 filed on Sep. 10, 2004 in the Japanese Patent Office, the entire contents of which are incorporated herein by reference.

BACKGROUND OF THE INVENTION

1. Field of the Invention

The present invention relates to a method and apparatus for image forming, and more particularly to a method and apparatus for image forming capable of effectively fixing a toner image on a recording sheet using induction heating in a small-size fixing unit having a simple structure produced at a low cost.

2. Description of the Related Art

Background image forming apparatuses, such as copiers and printers, include fixing units using an induction heating method. The induction heating method may shorten a time period required for the fixing units to become operable after the fixing units are powered on, and may reduce energy consumption.

One example of the fixing units includes a fixing belt, a support roller, an auxiliary fixing roller, an induction heater, and a pressure roller. The fixing belt is laid across the support roller and the auxiliary fixing roller. The induction heater faces the support roller via the fixing belt. The pressure roller faces the auxiliary fixing roller via the fixing belt. The induction heater includes an exciting coil and a core. The exciting coil is provided along the core and extends in directions parallel to a surface of a recording sheet in conveyance and perpendicular to a conveyance direction of the recording sheet which is conveyed between the pressure roller and the auxiliary fixing roller.

A high-frequency alternating current is applied to the exciting coil to generate a magnetic field around the exciting coil. The magnetic field induces an eddy current near a surface of the support roller. An electrical resistance of the support roller generates heat. The heat is transferred to the fixing belt from the support roller. The heated fixing belt heats and fixes a toner image on the recording sheet at a position where the pressure roller and the auxiliary fixing roller oppose each other. In this fixing unit, it is possible to increase a surface temperature of the fixing belt to a target fixing temperature in a short time period without consuming much energy.

Another example of the fixing units includes a fixing roller and two exciting coils. The fixing roller includes a hollow cylinder. One of the exciting coils is disposed in an interior of the cylinder. The other exciting coil is disposed above and along an outer circumferential surface of the cylinder. Each of the exciting coils includes a wire wound a plurality of times.

In the above fixing units, however, the induction heater including the exciting coil and the core has a complicated structure. The exciting coil including the wire wound the plurality of times requires a supporting member, and the supporting member has a complicated structure so that it may properly support the exciting coil. Those problems make it difficult to produce a small-size fixing unit at a low cost.

SUMMARY OF THE INVENTION

The present invention is directed to a novel image forming apparatus. In one aspect, the novel image forming apparatus includes an image forming unit and a fixing unit. The image forming unit is configured to form a toner image on a recording sheet. The fixing unit is configured to fix the toner image on the recording sheet. The fixing unit includes a magnetic flux generator and a heater. The magnetic flux generator is configured to generate a magnetic flux. The heater is configured to generate heat by the magnetic flux generated by the magnetic flux generator. The magnetic flux generator may surround the heater.

The magnetic flux generator may include a wire member. The magnetic flux generator may be formed in a U-like or semicircular shape and the heater may be placed in a gap of the magnetic flux generator. Otherwise, the magnetic flux generator may be formed in a loop-like or loop shape and the heater may be placed inside a loop of the magnetic flux generator.

The heater may include a magnetic metal. The magnetic metal may include a magnetic shunt alloy having a predetermined Curie point.

The fixing unit may include a plurality of the magnetic flux generators. The plurality of the magnetic flux generators may be configured to independently receive an alternating current and/or a direct current.

The wire member may include a single wire or a wire comprising a plurality of individual film insulated wires bunched or braided together (e.g., a litz wire). The wire member may include copper.

The image forming apparatus may further include an insulating layer configured to cover the magnetic flux generator. The magnetic flux generator may have a cross-sectional area in a range of approximately 1 $mm^2$ to approximately 28 $mm^2$.

The image forming apparatus may further include a ferrite core configured to cover a part of an outer circumferential surface of the magnetic flux generator.

The image forming apparatus may further include a ferromagnet disposed in a gap between the heater and the magnetic flux generator and outside a heat line L. The heat line L is equivalent to a width in an axial direction of the heater of a maximum-size recording sheet which can be fed in the fixing unit. The gap between the heater and the magnetic flux generator may be set in a range of approximately 0.5 mm to approximately 5 mm.

The magnetic flux generator may be configured to receive an alternating current.

The heater may be formed in a thin-walled shape having a thickness of approximately 0.1 mm to approximately 0.5 mm. The heater may include a fixing member configured to melt the toner image.

The image forming apparatus may further include a pressure roller configured to apply pressure to the recording sheet conveyed.

The fixing member may be formed in a roller shape contacting the pressure roller. As a non-limiting alternative, the fixing member may be formed in a belt shape and extended in an endless loop form. The magnetic flux generator may be disposed at a position facing outer and inner circumferential surfaces of the fixing member.

The image forming apparatus may further include a support roller and an auxiliary fixing roller. The support roller may be configured to support the fixing member at one end of the endless loop form. The auxiliary fixing roller may be configured to support the fixing member at another end of the endless loop form and to receive the pressure from the pressure roller via the recording sheet and the fixing member.

The magnetic flux generator may be disposed at a position facing an inner circumferential surface of the fixing member via the support roller.

The heater may be configured to apply heat to the fixing member. The heater may include the support roller configured to apply heat to the fixing member.

The present invention is also directed to a novel image forming method. In another aspect, the novel image forming method includes the steps of forming a toner image on a recording sheet and fixing the toner image on the recording sheet. The fixing step may include the sub-steps of generating magnetic flux by applying an alternating current to a magnetic flux generator positioned proximate to a heater to heat the heater by the magnetic flux to a predetermined temperature, and rotating the heater to fix the toner image on the recording sheet.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
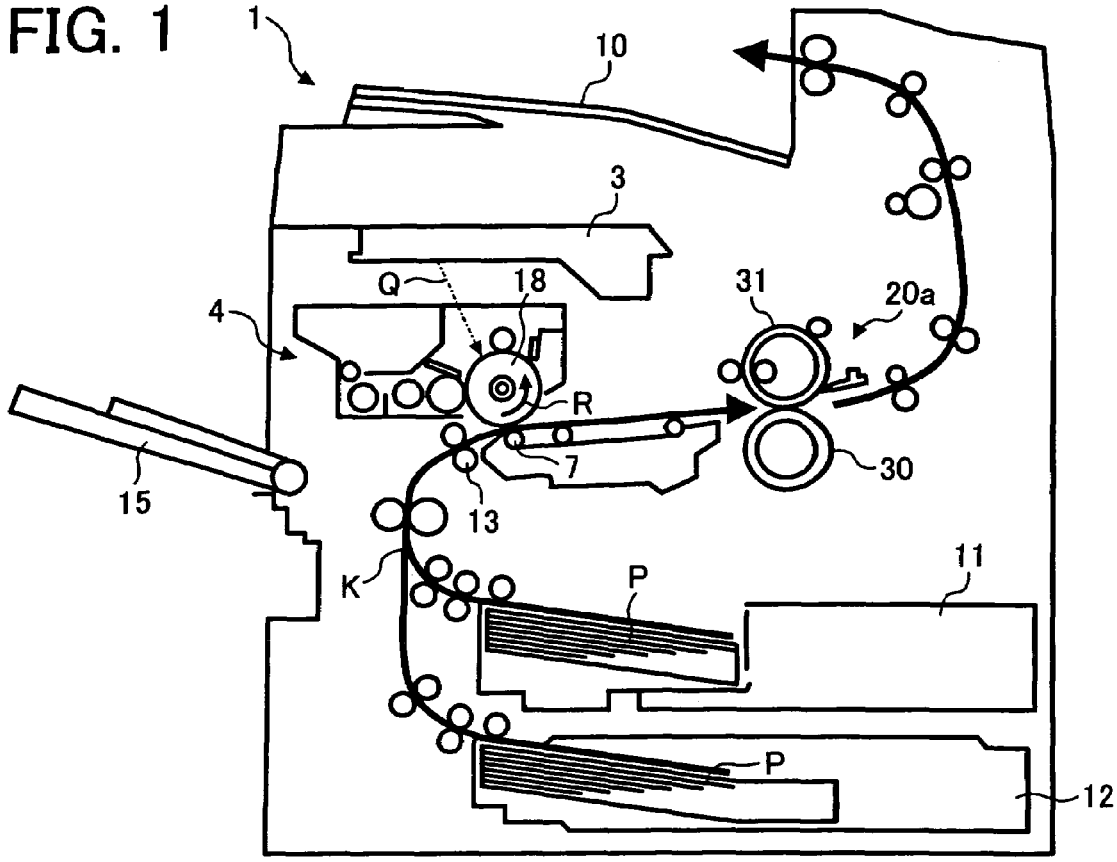
FIG. 1 is an illustration of an image forming apparatus according to an exemplary embodiment of the present invention.

In describing preferred embodiments illustrated in the drawings, specific terminology is employed for the sake of clarity. However, the disclosure of this invention is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus according to a non-limiting exemplary embodiment of the present invention is explained.

As illustrated in FIG. 1, an image forming apparatus 1 includes an exposure unit 3, a process cartridge 4, paper trays 11 and 12, a bypass tray 15, a conveyance path K, a roller 13, a transfer member 7, a fixing unit 20*a*, and an output tray 10. The process cartridge 4 includes a photoconductive drum 18. The fixing unit 20*a* includes a fixing roller 31 and a pressure roller 30.

The image forming apparatus 1 is configured to function as a laser printer. The exposure unit 3 is configured to irradiate a light Q onto the photoconductive drum 18 to form an electrostatic latent image on the photoconductive drum 18. The photoconductive drum 18 is configured to carry the electrostatic latent image. The process cartridge 4 is attachable to and detachable from the image forming apparatus 1 and enables formation of toner particles embodying the electrostatic latent image formed on the photoconductive drum 18 to form a toner image. The paper trays 11 and 12 are configured to load recording sheets P. The bypass tray 15 is also configured to load the recording sheets P. The conveyance path K is configured to convey the recording sheet P fed from the paper tray 11 or 12. The roller 13 is configured to feed the recording sheet P to the transfer member 7. The transfer member 7 is configured to transfer the toner image formed on the photoconductive drum 18 onto the recording sheet P. The fixing unit 20*a* is configured to fix the toner image transferred onto the recording sheet P. The fixing roller 31 is configured to apply heat to the recording sheet P to fix the toner image on the recording sheet P. The pressure roller 30 is configured to apply pressure to the recording sheet P to fix the toner image on the recording sheet P, and the output tray 10 is configured to receive the recording sheet P having the fixed toner image.

The photoconductive drum 18 rotates in a rotating direction R. The exposure unit 3 irradiates the light Q such as a laser beam onto the photoconductive drum 18 based on image information to form an electrostatic latent image on the photoconductive drum 18. In the process cartridge 4, toner adheres to the electrostatic latent image to form a toner image on the photoconductive drum 18. The transfer member 7 transfers the toner image onto the recording sheet P fed by the roller 13. The exposure unit 3, the process cartridge 4, and the transfer member 7 form an image forming unit.

Any one of the paper tray 11, the paper tray 12, and the bypass tray 15 may be automatically or manually selected. When the paper tray 11 is selected, for example, an uppermost sheet of the recording sheets P loaded in the paper tray 11 is conveyed toward the conveyance path K. The recording sheet P is conveyed through the conveyance path K to the roller 13. The recording sheet P is further conveyed to the transfer member 7 once the toner image formed on the photoconductive drum 18 is properly transferred onto the recording sheet P.

The recording sheet P is conveyed to the fixing unit 20*a*. In the fixing unit 20*a*, the recording sheet P is sandwiched between the fixing roller 31 and the pressure roller 30. The fixing roller 31 applies heat to the recording sheet P. The pressure roller 30 applies pressure to the recording sheet P. The heat and pressure fix the toner image on the recording sheet P. The recording sheet P having the fixed toner image T is output onto the output tray 10.

Figure 2:
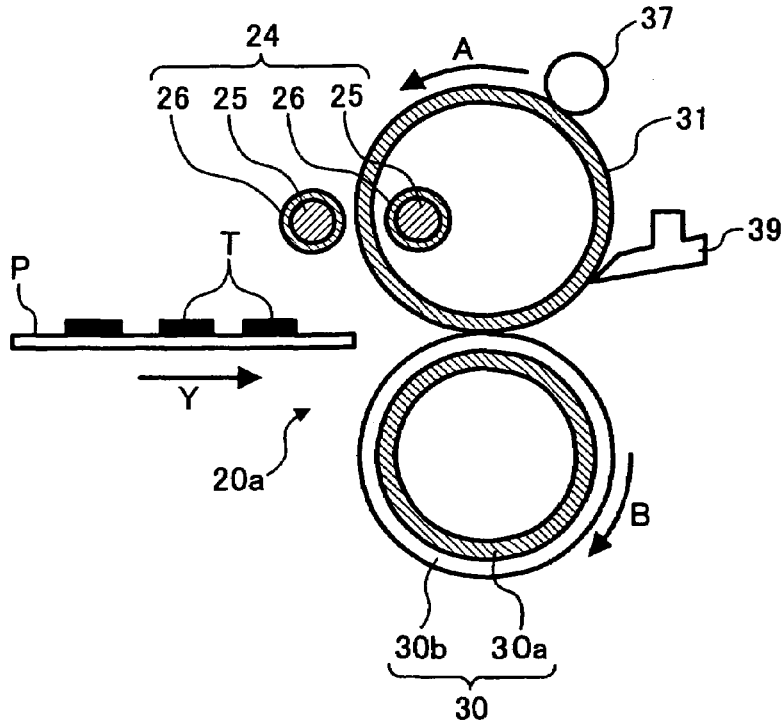
FIG. 2 is a cross-sectional view of a fixing unit of the image forming apparatus shown in FIG. 1.

As illustrated in FIG. 2, the fixing unit 20*a* further includes an induction heater 24, a releasing agent application roller 37, and a separator 39. The induction heater 24 includes a wire member 25 and an insulating layer 26. The pressure roller 30 includes a core 30*a* and an elastic layer 30*b*.

The induction heater 24 is configured to generate a magnetic field. The releasing agent application roller 37 is configured to apply a releasing agent to the fixing roller 31. The separator 39 is configured to help the recording sheet P conveyed in a direction Y separate from the fixing roller 31.

The wire member 25 is configured to generate a magnetic flux. The insulating layer 26 is configured to prevent an electric current from leaking from the fixing roller 31 to the wire member 25. The core 30*a* is configured to be formed under the elastic layer 30*b*. The elastic layer 30*b* is configured to be formed on the core 30*a*.

The fixing roller 31 may include a magnetic metal having a predetermined Curie point. Specifically, the fixing roller 31 may include a heating layer (not shown), an intermediate layer (not shown), and a releasing layer (not shown). The heating layer may include a magnetic shunt alloy and may have a thickness of approximately 0.2 mm. The magnetic shunt alloy may include an alloy of nickel and steel. The intermediate layer includes rubber such as silicone rubber, and has a thickness of approximately 300 μm. The releasing layer includes a resin, such as a fluorocarbon resin. Preferably, the fixing roller 31 is configured to form a thin-walled roller having a thickness of approximately 0.1 mm to approximately 0.5 mm, considering heating efficiency.

The pressure roller 30 includes the core 30*a* and the elastic layer 30*b*. The core 30*a* may include a metal, such as aluminum and/or copper. The elastic layer 30*b* includes silicone rubber and/or fluorocarbon rubber. The pressure roller 30 pressingly contacts the fixing roller 31. The recording sheet P is conveyed to a contact position (i.e., a fixing nip) where the pressure roller 30 contacts the fixing roller 31. In FIG. 2, the pressure roller 30 rotates in a rotating direction B.

The induction heater 24 includes the wire member 25 and the insulating layer 26. The wire member 25 includes a single wire. The single wire includes copper and has a diameter of approximately 5 mm. The wire member 25 may include an exciting coil. The exciting coil may include a metal, such as copper. The insulating layer 26 may cover an outer circumferential surface of the wire member 25 to prevent leakage of electric current from the fixing roller 31 to the wire member 25. The insulating layer 26 preferably includes a heat-resistant material such as polyimide-amide. One non-limiting example of the insulating layer 26 may include a glass cloth configured to cover the wire member 25.

The separator 39 is disposed at an exit of the contact position. The separator 39 helps the recording sheet P conveyed in the direction Y separate from the fixing roller 31. The releasing agent application roller 37 is disposed on an outer circumferential surface of the fixing roller 31 and applies a releasing agent to prevent offset during fixing.

A thermistor (not shown) may be disposed on the outer circumferential surface of the fixing roller 31. The thermistor detects a surface temperature of the fixing roller 31. A quantity of the magnetic flux output from the induction heater 24 may be adjusted based on the detected surface temperature. A thermostat (not shown) may also be disposed on the outer circumferential surface of the fixing roller 31. The thermostat prevents the surface temperature of the fixing roller 31 from overly increasing. When the surface temperature of the fixing roller 31 exceeds a predetermined temperature, the thermostat stops supplying an electric current to the induction heater 24.

According to the present embodiment, the fixing roller 31 includes the magnetic shunt alloy having a predetermined Curie point. Thus, it is possible to prevent the surface temperature of the fixing roller 31 from overly increasing even when the thermostat is not provided. The wire member 25 is proximate to the fixing roller 31 and faces the outer circumferential surface and an inner circumferential surface of the fixing roller 31, instead of facing only one of the outer and inner circumferential surfaces of the fixing roller 31. Thus, it is possible to prevent the surface temperature of the fixing roller 31 from overly increasing by setting the predetermined Curie point without disposing a low-resistance metal such as aluminum. Fewer parts are needed when the wire member 25 faces the outer and inner circumferential surfaces of the fixing roller 31 than if the wire member 25 faces only one of the outer and inner circumferential surfaces of the fixing roller 31. Because fewer parts are needed, costs are reduced.

Figure 3:
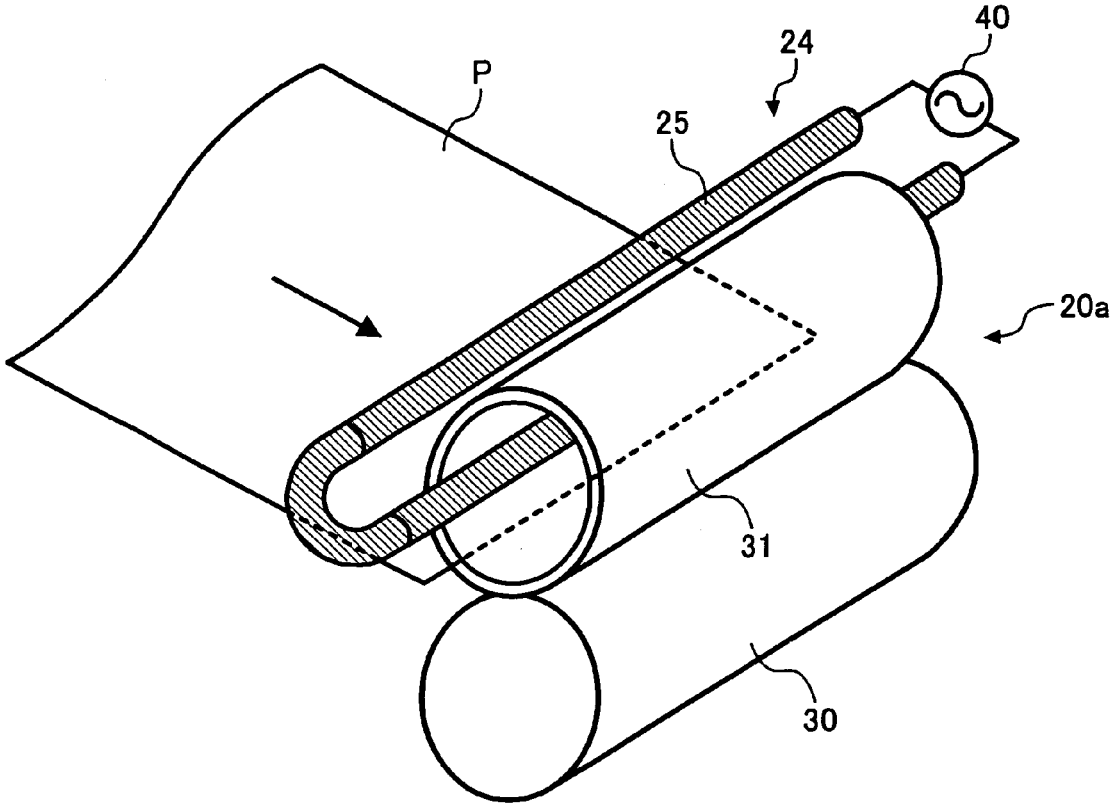
FIG. 3 is a perspective view of the fixing unit shown in FIG. 2.

As illustrated in FIG. 3, the induction heater 24 further includes a high-frequency power source 40. The high-frequency power source 40 is configured to apply current, such as an attenuating current, to the wire member 25.

The wire member 25 includes a single wire. The wire member 25 is formed in a loop-like shape and the fixing roller 31 is placed inside a loop of the wire member 25. The wire member 25 may be formed in a semicircular shape (such as a U-like shape) and the fixing roller 31 may be placed in a gap of the wire member 25. The wire member 25 faces the outer circumferential surface (i.e., a front surface) and the inner circumferential surface (i.e., a back surface) of the fixing roller 31. The wire member 25 may be disposed substantially parallel to an axial direction of the fixing roller 31, and extends in the axial direction of the fixing roller 31. Specifically, one end of the wire member 25 in the axial direction of the fixing roller 31 forms a loopback portion. The loopback portion connects a portion of the wire member 25 that faces the outer circumferential surface of the fixing roller 31 with a portion of the wire member 25 that faces the inner circumferential surface of the fixing roller 31. The other end of the wire member 25 in the axial direction of the fixing roller 31 is connected with the high-frequency power source 40. The high-frequency power source 40 includes an exciting circuit (i.e., an inverter circuit). The high-frequency power source 40 applies an alternating current to the wire member 25. The alternating current has a frequency of approximately 1 kHz to approximately 1 MHz, preferably approximately 20 kHz to approximately 200 kHz, and a power of approximately 1,200 W.

Figure 4:
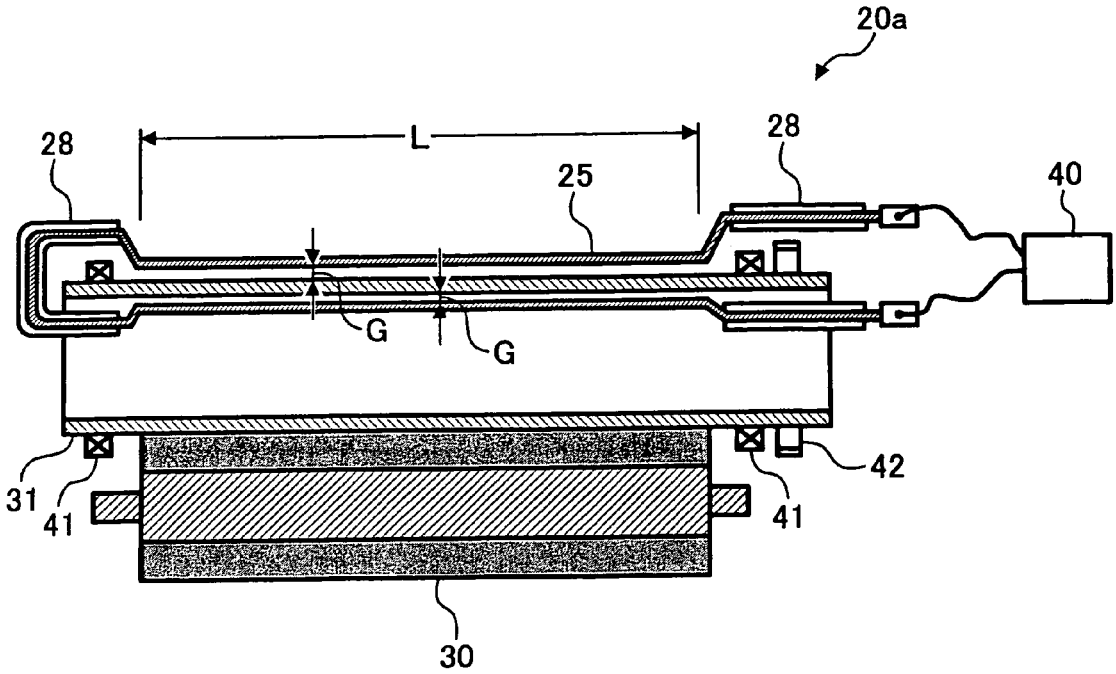
FIG. 4 is a cross-sectional view of the fixing unit shown in FIG. 3.

As illustrated in FIG. 4, the fixing unit 20*a* further includes ferromagnets 28, bearings 41, and a gear 42. The ferromagnets 28 are configured to suppress induction heating by the wire member 25. The bearings 41 are configured to support the fixing roller 31. The gear 42 is configured to rotate the fixing roller 31.

A gap G is formed in a direction perpendicular to the axial direction of the fixing roller 31. The gap G is formed between the outer circumferential surface of the fixing roller 31 and the wire member 25 facing the outer circumferential surface of the fixing roller 31 and between the inner circumferential surface of the fixing roller 31 and the wire member 25 facing the inner circumferential surface of the fixing roller 31. The gap G is preferably set in a range of approximately 0.5 mm to approximately 5 mm, considering heating efficiency of induction heating. According to the present embodiment, the gap G is set to approximately 2 mm, considering heating efficiency and safety of induction heating.

A cross-sectional area of the wire member 25 is preferably set in a range of approximately 1 $mm^2$ to approximately 28 $mm^2$, considering a heating efficiency of induction heating. According to the present embodiment, a cross section of the wire member 25 is formed in a circular shape. A diameter of the circular shape is set to approximately 5 mm. Otherwise, the cross section of the wire member 25 may be formed in a rectangular shape of approximately 3 mm by approximately 5 mm, for example.

According to the present embodiment, the wire member 25 includes a single wire. However, the wire member 25 may include a litz wire. If the wire member 25 including the litz wire is positioned proximate to the fixing roller 31 to face the outer and inner circumferential surfaces of the fixing roller 31 as the wire member 25 including the single wire does, the fixing roller 31 can be heated by induction heating.

The ferromagnets 28 are disposed in the gap between the outer circumferential surface of the fixing roller 31 and the wire member 25 facing the outer circumferential surface of the fixing roller 31 and between the inner circumferential surface of the fixing roller 31 and the wire member 25 facing the inner circumferential surface of the fixing roller 31. The gap is formed on both ends of the wire member 25 in the axial direction of the fixing roller 31 outside a heat line L. The heat line L is preferably equivalent to a width in the axial direction of the fixing roller 31 of the maximum-size recording sheet P which can be fed between the fixing roller 31 and the pressure roller 30. The ferromagnets 28 include ferrite. Heating the fixing roller 31 by induction heating is suppressed around the both ends of the wire member 25. The suppressed heating prevents surface temperatures of both ends of the fixing roller 31 in the axial direction of the fixing roller 31 from overly increasing. The suppressed heating also prevents temperatures of the bearings 41 and the gear 42 from increasing.

Referring to FIGS. 2 and 3, a fixing process performed by the fixing unit 20*a* is explained below. The fixing roller 31 rotates in a rotating direction A, and the pressure roller 30 rotates in the rotating direction B.

The high-frequency power source 40 applies a high-frequency alternating current to the wire member 25. Magnetic lines of force are formed in a loop formed by the wire member 25. Directions of the magnetic lines of force alternately switch in opposite directions to form an alternating magnetic field. When a temperature of the heating layer of the fixing roller 31 is not greater than the predetermined Curie point, an eddy current is generated in the heating layer. An electric resistance of the heating layer generates heat. The heat is transferred to the intermediate layer and the releasing layer of the fixing roller 31.

The fixing roller 31 is heated at a position where the wire member 25 faces the fixing roller 31 (i.e., a face position). Namely, a portion on the outer circumferential surface of the fixing roller 31 is heated while the portion passes under the face position. When the heated portion reaches the contact position, the heated portion melts a toner image T on the recording sheet P conveyed in the direction Y.

Specifically, the toner image T is formed on the recording sheet P through exposure and development processes as described above. A guide board (not shown) guides the recording sheet P in the direction Y to the contact position. The recording sheet P is inserted between the fixing roller 31 and the pressure roller 30. The fixing roller 31 applies heat to the recording sheet P. The pressure roller 30 applies pressure to the recording sheet P. The heat and pressure fix the toner image T on the recording sheet P. The recording sheet P having the fixed toner image is fed out of the contact position.

The portion on the outer circumferential surface of the fixing roller 31 passes under the separator 39 and the releasing agent application roller 37. The portion on the outer circumferential surface of the fixing roller 31 faces the wire member 25 again. The operations described above are repeated to complete the fixing process.

When the temperature of the heating layer of the fixing roller 31 exceeds a predetermined Curie point, the heating layer generates less heat. Namely, the heating layer loses its magnetic properties, and generation of the eddy current is suppressed. Thus, generation of heat is suppressed to prevent the temperature of the heating layer from overly increasing.

According to the present embodiment, the fixing roller 31 is used as a fixing member for fixing the toner image T on the recording sheet P and a heater for heating the fixing member. The wire member 25 is used as a magnetic flux generator for generating a magnetic flux.

As described above, the wire member 25 faces the outer and inner circumferential surfaces of the fixing roller 31. The wire member 25 includes a single wire wound around the outer and inner circumferential surfaces of the fixing roller 31 once. The wire member 25 including the single wire wound once is smaller in size, more simple in structure, and lower in production cost than the wire member 25 including the single wire wound a plurality of times. Surrounding parts such as the ferromagnets 28 can also be simplified. Thus, the fixing unit 20*a* can be small in size, low in production cost, and high in heating efficiency.

Figure 5:
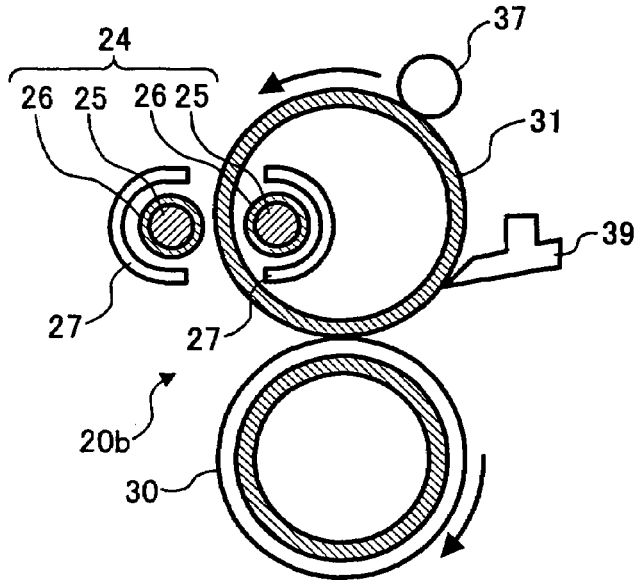
FIG. 5 is a cross-sectional view of a fixing unit according to another exemplary embodiment of the present invention.

Referring to FIG. 5, another exemplary embodiment of the present invention is explained. In this non-limiting embodiment, a fixing unit 20*b* includes parts included in the fixing unit 20*a*, but further includes a ferrite core 27.

The fixing unit 20*b* is configured to fix the toner image T on the recording sheet P. The ferrite core 27 is configured to deflect a magnetic flux generated by the wire member 25 to the outer and inner circumferential surfaces of the fixing roller 31.

The insulating layer 26 covers the outer circumferential surface of the wire member 25. The ferrite core 27 covers a part of the outer circumferential surface of the wire member 25 in a circumferential direction of the wire member 25. The covered part does not face the outer and inner circumferential surfaces of the fixing roller 31. A predetermined gap is provided between the outer circumferential surface of the wire member 25 and an inner circumferential surface of the ferrite core 27. The ferrite core 27 includes an exciting coil core, which is formed in a hemi-cylindrical shape and includes a ferromagnet such as ferrite. The ferrite core 27 has a relative permeability of approximately 3,500.

The ferrite core 27 effectively deflects the magnetic flux generated by the wire member 25 to the outer and inner circumferential surfaces of the fixing roller 31. Thus, diffusion of the magnetic lines of force is suppressed, resulting in increased heating efficiency of the fixing roller 31.

According to the present embodiment, the wire member 25 is used as the magnetic flux generator. As described above, the wire member 25 faces the outer and inner circumferential surfaces of the fixing roller 31. The ferrite core 27 covers a part of the outer circumferential surface of the wire member 25 in the circumferential direction of the wire member 25. Thus, the fixing unit 20*b* can be small in size, low in production cost, and high in heating efficiency.

Figure 6:
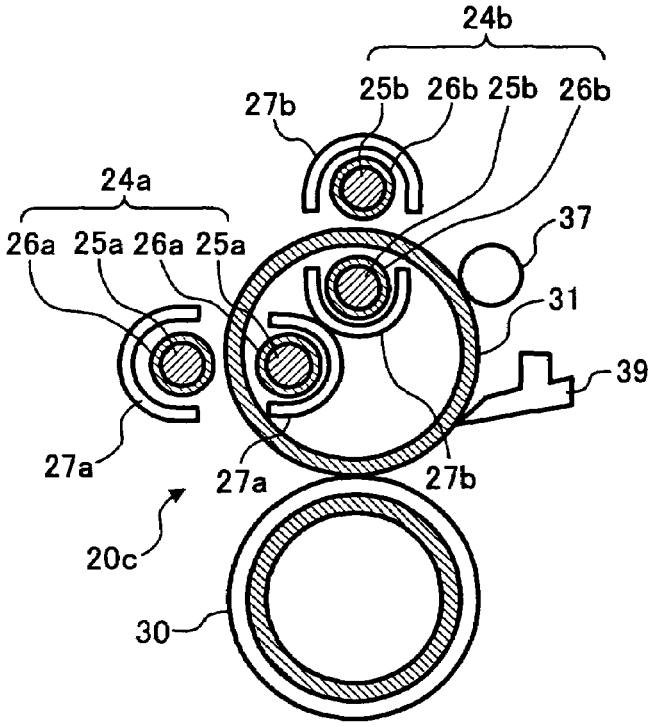
FIG. 6 is a cross-sectional view of a fixing unit according to another exemplary embodiment of the present invention.

Referring to FIG. 6, another exemplary embodiment of the present invention is explained. In this non-limiting embodiment, a fixing unit 20*c* includes parts included in the fixing unit 20*b*, but further includes another induction heater and ferrite core. Namely, the fixing unit 20*c* includes induction heaters 24*a* and 24*b* and ferrite cores 27*a* and 27*b*.

The induction heater 24*a* includes a wire member 25*a* and an insulating layer 26*a*. The induction heater 24*b* includes a wire member 25*b* and an insulating layer 26*b*.

The fixing unit 20*c* is configured to fix the toner image T on the recording sheet P. Each of the induction heaters 24*a* and 24*b* is configured to generate a magnetic field. Each of the ferrite cores 27*a* and 27*b* is configured to deflect a magnetic flux generated by each of the wire members 25*a* and 25*b* to the outer and inner circumferential surfaces of the fixing roller 31. Each of the wire members 25*a* and 25*b* is configured to generate a magnetic flux. Each of the insulating layers 26*a* and 26*b* is configured to prevent an electric current from leaking from the fixing roller 31 to the wire member 25.

Each of the wire members 25*a* and 25*b* faces the outer and inner circumferential surfaces of the fixing roller 31. The insulating layer 26*a* covers an outer circumferential surface of the wire member 25*a*. The insulating layer 26*b* covers an outer circumferential surface of the wire member 25*b*. The ferrite core 27*a* covers a part of the outer circumferential surface of the wire member 25*a* in a circumferential direction of the wire member 25*a*. The ferrite core 27*b* covers a part of the outer circumferential surface of the wire member 25*b* in a circumferential direction of the wire member 25*b*. The wire member 25*a* is connected with the high-frequency power source 40. The wire member 25*b* is connected with another high-frequency power source 40; The high-frequency power source 40 applies a current, such as an alternating current, to the wire member 25*a*. The other high-frequency power source 40 applies a current, such as an alternating current, to the wire member 25*b*.

The fixing roller 31 is heated at two positions where the wire members 25*a* and 25*b* face the fixing roller 31. Namely, each of the induction heaters 24*a* and 24*b* heats the fixing roller 31 with heating efficiency equivalent to the heating efficiency obtained according to the previous embodiment. Thus, the fixing roller 31 is heated with improved heating efficiency, and the surface temperature of the fixing roller 31 reaches a predetermined fixing temperature in a short time period.

An electric current may be independently applied to each of the wire members 25*a* and 25*b*. The electric current includes an alternating current and a direct current. The electric current may be applied by any of the three ways described below, for example. In one way, alternating current is independently applied to each of the wire members 25*a* and 25*b*. In another way, direct current is independently applied to each of the wire members 25*a* and 25*b*. In yet another way, alternating current is applied to one of the wire members 25*a* and 25*b*, and direct current is applied to the other. In any of these ways, the exciting circuit (i.e., the inverter circuit) converts the alternating current and the direct current into high-frequency currents, which are applied to the wire members 25*a* and 25*b*. According to the present embodiment, the wire members 25*a* and 25*b* are used as the magnetic flux generators.

As described above, a plurality of wire members, the wire members 25*a* and 25*b*, face the outer and inner circumferential surfaces of the fixing roller 31. Thus, the fixing unit 20*c* can be small in size, low in production cost, and high in heating efficiency.

Figure 7:
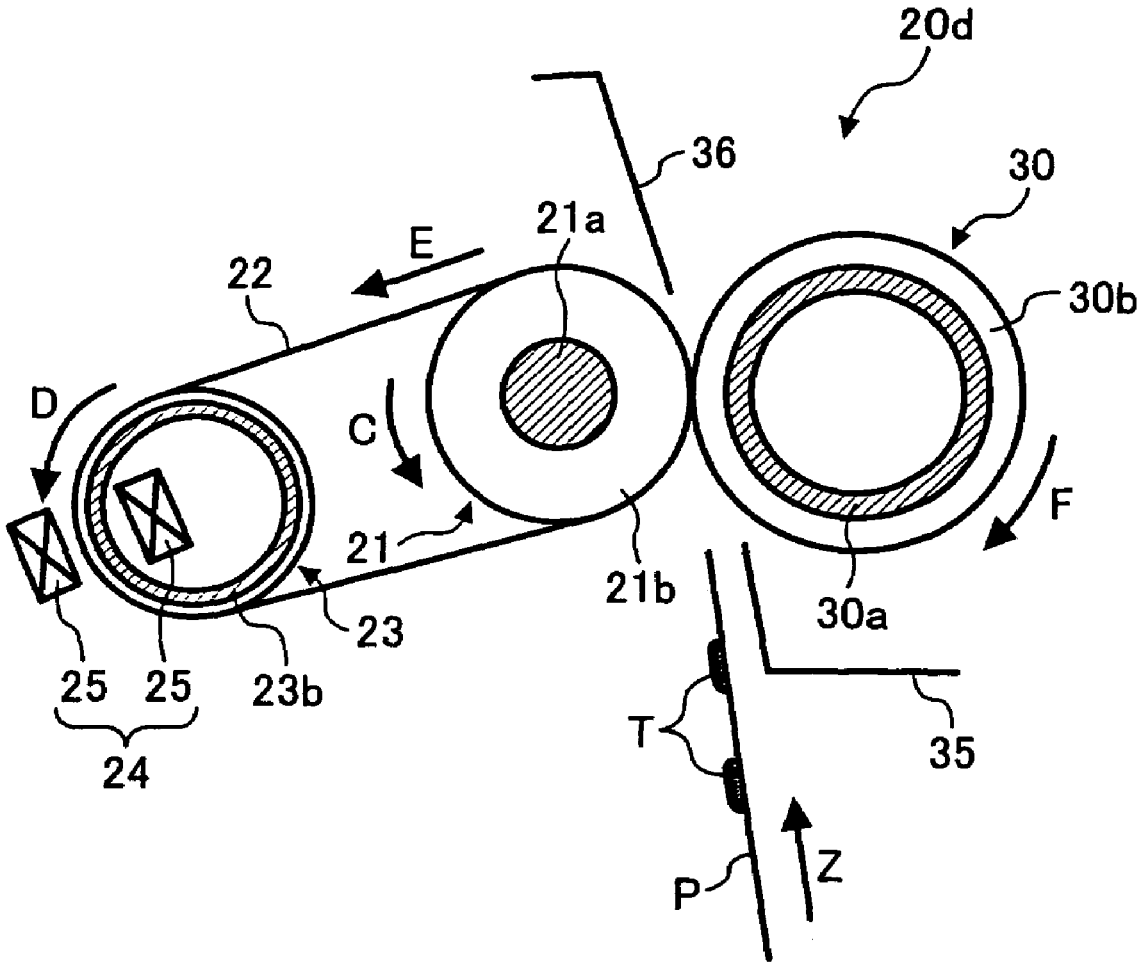
FIG. 7 is a cross-sectional view of a fixing unit according to another exemplary embodiment of the present invention.

Referring to FIG. 7, another exemplary embodiment of the present invention is explained. In this non-limiting embodiment, a fixing unit 20*d* includes an auxiliary fixing roller 21, a fixing belt 22, a support roller 23, the induction heater 24, the pressure roller 30, a guide board 35, and a separation board 36.

The auxiliary fixing roller 21 includes a core 21*a* and an elastic layer 21*b*. The support roller 23 includes a heating layer 23*b*. The induction heater 24 includes the wire member 25. The pressure roller 30 includes the core 30*a* and the elastic layer 30*b*.

The fixing unit 20*d* is configured to fix the toner image T on the recording sheet P. The auxiliary fixing roller 21 is configured to support the fixing belt 22. The fixing belt 22 is configured to apply heat to the recording sheet P to fix the toner image T on the recording sheet P. The support roller 23 is configured to support and heat the fixing belt 22. The guide board 35 is configured to guide the recording sheet P conveyed in a direction Z to the fixing belt 22. The separation board 36 is configured to guide the recording sheet P and help the recording sheet P separate from the fixing belt 22.

The core 21*a* is configured to be formed under the elastic layer 21*b*. The elastic layer 21*b* is configured to be formed on a surface of the core 21*a*. The heating layer 23*b* is configured to generate heat by the magnetic flux generated by the wire member 25.

The core 21*a* may include a metal, such as stainless steel. The elastic layer 21*b* may include rubber, such as silicone rubber. A driver (not shown) drives and rotates the auxiliary fixing roller 21 in a rotating direction C.

The heating layer 23*b* is formed in a cylindrical shape and includes a magnetic shunt alloy. The heating layer 23*b* has a thickness of approximately 0.5 mm. The support roller 23 rotates in a rotating direction D. The wire member 25 is disposed to face an outer circumferential surface (i.e., a front surface) of the support roller 23 via the fixing belt 22 and an inner circumferential surface (i.e., a back surface) of the support roller 23. According to the present embodiment, the cross section of the wire member 25 is formed in a rectangular shape. The support roller 23 includes only the heating layer 23*b*. However, the support roller 23 may include a reinforcing layer (not shown), an elastic layer (not shown), and/or an insulating layer (not shown) on the heating layer 23*b*.

The fixing belt 22 is laid across the support roller 23 and the auxiliary fixing roller 21 in a tensioned condition that the support roller 23 and the auxiliary fixing roller 21 support the fixing belt 22. The fixing belt 22 includes a multi-layered, endless belt. The fixing belt 22 may include a base layer (not shown), a heating layer (not shown), an elastic layer (not shown), and a releasing layer (not shown). The heating layer may include a magnetic shunt alloy having a predetermined Curie point.

The wire member 25 is formed in a loop-like shape. A part of the fixing belt 22 and the support roller 23 in a circumferential direction is placed inside a loop of the wire member 25. One end of the wire member 25 in an axial direction of the support roller 23 forms a loopback portion. The loopback portion connects a portion of the wire member 25 that faces the outer circumferential surface of the support roller 23 and a portion of the wire member 25 that faces the inner circumferential surface of the support roller 23. The other end of the wire member 25 in the axial direction of the support roller 23 is connected with the high-frequency power source 40. The high-frequency power source 40 applies an alternating current to the wire member 25. The alternating current has a frequency of approximately 1 kHz to approximately 1 MHz.

The core 30*a* includes a metal, such as aluminum or copper. The elastic layer 30*b* includes rubber, such as fluorocarbon rubber or silicone rubber. The pressure roller 30 presses the auxiliary fixing roller 21 via the fixing belt 22. The recording sheet P is conveyed to a contact position (i.e., a fixing nip) where the pressure roller 30 contacts the fixing belt 22.

At an entrance to the contact position, the guide board 35 is disposed to guide the recording sheet P conveyed in the direction Z to the contact position. At an exit from the contact position, the separation board 36 is disposed to guide the recording sheet P and help the recording sheet P separate from the fixing belt 22.

A fixing process performed by the fixing unit 20*d* is explained below. The auxiliary fixing roller 21 rotates in the rotating direction C. The auxiliary fixing roller 21 drives and rotates the fixing belt 22 in a rotating direction E. Accordingly, the support roller 23 rotates in the rotating direction D and the pressure roller 30 rotates in a rotating direction F. The fixing belt 22 is heated at a position where the wire member 25 faces the fixing belt 22 (i.e., a face position).

Specifically, the high-frequency power source 40 applies a high-frequency alternating current to the wire member 25. Magnetic lines of force are formed in the loop of the wire member 25. Directions of the magnetic lines of force alternately switch in opposite directions to form an alternating magnetic field. When temperatures of the support roller 23 and the heating layer of the fixing belt 22 are not greater than the predetermined Curie points, eddy currents are generated on the inner circumferential surface of the support roller 23 and in the heating layer of the fixing belt 22. Electric resistances of the support roller 23 and the heating layer of the fixing belt 22 generate heat, and the heat is transferred to the other layers of the fixing belt 22.

The heat is transferred to a portion on the outer circumferential surface of the fixing belt 22 at the face position. The heated portion reaches the contact position. The heated portion heats and melts the toner image T on the recording sheet P conveyed in the direction Z. Specifically, the guide board 35 guides the recording sheet P conveyed in the direction Z to the contact position. The recording sheet P is inserted between the fixing belt 22 and the pressure roller 30. The fixing belt 22 applies heat to the recording sheet P. The pressure roller 30 applies pressure to the recording sheet P. The heat and pressure fix the toner image T on the recording sheet P. The recording sheet P is fed between the fixing belt 22 and the pressure roller 30.

After passing the contact position, the portion on the outer circumferential surface of the fixing belt 22 reaches the face position again. The operations described above are repeated to complete the fixing process.

When the temperatures of the support roller 23 and the heating layer of the fixing belt 22 exceed the predetermined Curie points, generation of the heat is suppressed to prevent the temperatures of the support roller 23 and the heating layer of the fixing belt 22 from overly increasing.

As described above, the wire member 25 faces the outer circumferential surface of the support roller 23 via the fixing belt 22 and the inner circumferential surfaces of the support roller 23. The wire member 25 includes the single wire wound around the outer and inner circumferential surfaces of the support roller 23 once. The wire member 25 including the single wire wound once is smaller in size, more simple in structure, and lower in production cost than the wire member 25 including the single wire wound for a plurality of times. Thus, the fixing unit 20*d* can be small in size, low in production cost, and high in heating efficiency.

According to the present embodiment, the fixing belt 22 is used as the fixing member. The fixing belt 22 and the support roller 23 are used as the heaters. The wire member 25 is used as the magnetic flux generator.

Alternatively, only one of the fixing belt 22 and the support roller 23 may be used as the heater. In this case, the wire member 25 faces the outer and inner circumferential surfaces of the one of the fixing belt 22 and the support roller 23. Thus, effects similar to the effects according to the present embodiment can be obtained.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

Obviously, numerous modifications and variations of the present invention are possible in light of the above teachings. It is therefore to be understood that within the scope of the appended claims, the invention may be practiced otherwise than as specifically described therein.

The invention claimed is:

1. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, and a heat generating member formed in a thin-walled shape having a thickness of between approximately 0.1 mm and approximately 0.5 mm and configured to generate heat using the magnetic flux generated by the magnetic flux generator, wherein the magnetic flux generator is wound around outer and inner circumferential surfaces of the heat generating member.

2. The image forming apparatus according to claim 1, wherein the magnetic flux generator is formed in a semicircular shape.

3. The image forming apparatus according to claim 2, wherein the heat generating member is placed in a gap of the magnetic flux generator.

4. The image forming apparatus according to claim 1, wherein the magnetic flux generator is formed in a loop shape.

5. The image forming apparatus according to claim 4, wherein the heat generating member is placed inside a loop of the magnetic flux generator.

6. The image forming apparatus according to claim 1, wherein the heat generating member includes a magnetic metal.

7. The image forming apparatus according to claim 6, wherein the magnetic metal includes a magnetic shunt alloy having a predetermined Curie point.

8. The image forming apparatus according to claim 1, wherein the fixing unit includes a plurality of magnetic flux generators.

9. The image forming apparatus according to claim 8, wherein the plurality of magnetic flux generators are configured to independently receive either an alternating current or a direct current.

10. The image forming apparatus according to claim 2, wherein the magnetic flux generator has a wire member which includes a single wire.

11. The image forming apparatus according to claim 1, wherein the magnetic flux generator has a wire member which includes a litz wire.

12. The image forming apparatus according to claim 1, wherein the magnetic flux generator has a wire member which includes copper.

13. The image forming apparatus according to claim 1, wherein the magnetic flux generator includes at least one wire member, and further comprising:

an insulating layer configured to cover the magnetic flux generator.

14. The image forming apparatus according to claim 1, wherein the magnetic flux generator has a cross-sectional area between approximately 1 $mm^2$ to approximately 28 $mm^2$.

15. The image forming apparatus according to claim 1, further comprising:

a ferrite core configured to cover at least a portion of an outer circumferential surface of the magnetic flux generator.

16. The image forming apparatus according to claim 1, further comprising:

a ferromagnet disposed in a gap between the heat generating member and the magnetic flux generator and outside a heat line L, wherein a dimension of the heat line L equals a width in an axial direction of the heat generating member of a maximum size recording sheet.

17. The image forming apparatus according to claim 16, wherein the gap between the heat generating member and the magnetic flux generator is between approximately 0.5 mm and approximately 5 mm.

18. The image forming apparatus according to claim 1, wherein the magnetic flux generator is configured to receive an alternating current.

19. The image forming apparatus according to claim 1, wherein the heat generating member includes a fixing member configured to melt the toner image.

20. The image forming apparatus according to claim 19, further comprising:

a pressure roller configured to apply pressure to the recording sheet, wherein the fixing member is formed in a roller shape contacting the pressure roller and the magnetic flux generator is disposed at a position facing outer and inner circumferential surfaces of the fixing member.

21. The image forming apparatus according to claim 19, wherein the fixing member is formed in a belt shape and is extended in an endless loop form and the magnetic flux generator is disposed at a position facing outer and inner circumferential surfaces of the fixing member.

22. The image forming apparatus according to claim 21, further comprising:

a pressure roller configured to apply pressure to the recording sheet;

a support roller configured to support the fixing member at a first end of the endless loop form; and an auxiliary fixing roller configured to support the fixing member at a second end of the endless loop form and to receive the pressure from the pressure roller via the recording sheet and the fixing member.

23. The image forming apparatus according to claim 22, wherein the magnetic flux generator is disposed at a position facing the inner circumferential surface of the fixing member via the support roller.

24. The image forming apparatus according to claim 23, wherein the heat generating member is configured to apply heat to the fixing member.

25. The image forming apparatus according to claim 24, wherein the heat generating member includes the support roller configured to apply heat to the fixing member.

26. A fixing unit configured to fix a toner image on a recording sheet, comprising:

a magnetic flux generator configured to generate a magnetic flux; and a heat generating member formed in a thin-walled shape having a thickness of between approximately 0.1 mm and approximately 0.5 mm and positioned to surround at least a portion of the magnetic flux generator, the heat generating member configured to generate heat by the magnetic flux generated by the magnetic flux generator, wherein the magnetic flux generator is wound around outer and inner circumferential surfaces of the heat generating member.

27. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, and a heat generating member configured to generate heat using the magnetic flux generated by the magnetic flux generator, wherein the magnetic flux generator is wound around outer and inner circumferential surfaces of the heat generating member, and has a cross-sectional area between approximately 1 $mm^2$ to approximately 28 $mm^2$.

28. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, a heat generating member configured to generate heat using the magnetic flux generated by the magnetic flux generator, and a ferromagnet disposed in a gap between the heat generating member and the magnetic flux generator and outside a heat line L, wherein a dimension of the heat line L equals a width in an axial direction of the heat generating member of a maximum size recording sheet, and the magnetic flux generator is wound around outer and inner circumferential surfaces of the heat generating member.

29. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, and a heat generating member configured to generate heat using the magnetic flux generated by the magnetic flux generator, wherein a gap between the heat generating member and the magnetic flux generator is in a range of from approximately 0.5 mm to approximately 5 mm, and the magnetic flux generator is wound around outer and inner circumferential surfaces of the heat generating member.

30. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, a heat generating member configured to generate heat using the magnetic flux generated by the magnetic flux generator, at least one bearing configured to support the heat generating member, and a ferromagnet disposed at each end of the heat generating member, between the magnetic flux generator and the heat generating member, and configured to suppress the generation of heat in the at least one bearing by the magnetic flux, wherein the magnetic flux generator is wound around outer and inner circumferential surfaces of the heat generating member.

31. The image forming apparatus according to claim 27, wherein the heat generating member includes a magnetic shunt alloy having a predetermined Curie point.

32. The image forming apparatus according to claim 28, wherein the heat generating member includes a magnetic shunt alloy having a predetermined Curie point.

33. The image forming apparatus according to claim 29, wherein the heat generating member includes a magnetic shunt alloy having a predetermined Curie point.

34. The image forming apparatus according to claim 30, wherein the heat generating member includes a magnetic shunt alloy having a predetermined Curie point.

35. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, a heat generating member formed in a thin-walled shape having a thickness of between approximately 0.1 mm and approximately 0.5 mm and configured to generate heat using the magnetic flux generated by the magnetic flux generator, and a fixing belt configured to melt the toner image, wherein the magnetic flux generator is wound around outer and inner circumferential surfaces of the heat generating member, and the heat generating member has a roller shape and is configured to heat the fixing belt.

36. An image forming apparatus, comprising:

an image forming unit configured to form a toner image on a recording sheet; and a fixing unit configured to fix the toner image on the recording sheet, the fixing unit including, a magnetic flux generator configured to generate a magnetic flux, a heat generating member formed in a thin-walled roller shape having a thickness of between approximately 0.1 mm and approximately 0.5 mm and configured to generate heat using the magnetic flux generated by the magnetic flux generator, a fixing belt configured to melt the toner image, and a roller configured to support the fixing belt together with the heat generating member, wherein the magnetic flux generator is wound around outer and inner circumferential surfaces of the heat generating member.

37. The image forming apparatus according to claim 36, wherein the fixing unit further includes a pressing member configured to oppose the roller via the fixing belt.

* * * * *